United States Patent [19]

Docken

[11] 4,353,150

[45] Oct. 12, 1982

[54] ROPE STRETCHING AND TIGHTENING DEVICE

[76] Inventor: Richard E. Docken, 13910 NE. 14th St., Bldg. 4, Apt. 1, Bellevue, Wash. 98005

[21] Appl. No.: 203,157

[22] Filed: Nov. 3, 1980

[51] Int. Cl.[3] ..... A43C 11/00; B66F 3/02; B25B 25/00

[52] U.S. Cl. ..... 24/71.1; 24/68 CD; 254/249

[58] Field of Search ..... 254/249, 256, 248, 258, 254/243; 24/68 CD, 68 CT, 68 D, 71 ST, 71 TD, 71 CT, 71.1, 71.2

[56] References Cited

U.S. PATENT DOCUMENTS

| | | | |
|---|---|---|---|
| 797,669 | 8/1905 | Dems . | |
| 1,546,090 | 7/1925 | LeBlanc | 254/246 |
| 1,632,644 | 6/1927 | Crowell . | |
| 2,336,818 | 12/1943 | Topinka | 24/71.1 |
| 2,459,393 | 1/1949 | Raniville | 254/246 |
| 2,648,109 | 8/1953 | Cline | 24/71.1 |
| 3,574,342 | 4/1971 | Berns | 254/243 |
| 3,591,140 | 7/1971 | McCoy | 254/230 |
| 3,641,630 | 2/1972 | Farley | 24/68 CD |
| 3,735,452 | 5/1973 | Burroughs | 24/68 CD |
| 3,866,272 | 2/1975 | Prete, Jr. et al. | 24/68 CD |
| 4,001,920 | 7/1975 | Johnson | 24/68 CD |
| 4,045,002 | 8/1977 | Miller | 24/68 CD |
| 4,102,018 | 7/1978 | Kawahara | 24/68 CD |

*Primary Examiner*—Billy S. Taylor

*Attorney, Agent, or Firm*—Seed, Berry, Vernon & Baynham

[57] ABSTRACT

A device for increasing the tension in a taut rope segment by increasing the path length which the rope must travel. The path length is increased by first engaging an essentially straight line segment of rope at two points spaced apart on the rope segment and physically restricting the ability of the rope to move in one transverse direction at these points. The path length of the rope is then increased by deflecting the rope outward, away from the straight line pathway at a point between the two points of restricted motion.

3 Claims, 8 Drawing Figures

ROPE STRETCHING AND TIGHTENING DEVICE

BACKGROUND OF THE INVENTION

1. Field of the Invention

The invention relates to the field of devices for tightening or cinching elongated cord-like members and, more particularly, to the field of rope stretching and tightening devices.

2. Description of the Prior Art

Existing devices for increasing the tension in straps, cords or other filament members used to secure or tie objects down generally involve some means of decreasing the total length of the cord segment used.

A known method of securing objects on pallets, for example, involves placing straps around a loaded pallet and tightening the straps with a device that grasps the straps at two locations and gathers the strap to reduce the total length of strap which surrounds the pallet. The tension in the strap is thereby increased.

Other known methods of increasing the tension in cord segments entail inserting a retractable mechanical device into the cord segment. Such a device is normally attached to the two ends of the cord, and then manipulated so that the length of the device is decreased. By decreasing the length of the device, which has been inserted into the cord segment, the effective length of the segment is thereby decreased and the tension in the cord segment increased.

Winch means are also used to take up the slack in a rope or strap segment.

These methods of tightening, however, are not well suited to tightening rope, especially when securing odd-shaped items on a one-time basis. Jobs such as these often require that one person develop adequate tension in the rope to secure the objects and maintain that tension while tieing a knot in the rope. When such a procedure is used, it is often difficult to produce adequate tension in the rope so as to safely secure the items being bundled by the rope.

It will be appreciated from the foregoing that there is a need for a device which can be easily used and transported by one person and which will permit the tension in a rope, once tied, to be increased so as to remove any undesired slack.

SUMMARY OF THE INVENTION

The principal object of this invention is to provide a means of obtaining adequate tension in a rope segment used to secure objects. It is another object of the invention to permit one person to easily remove slack from a rope segment once it is tied. It is yet another object of the invention to provide a means to increase the tension in any straight-line segment of taut rope.

These and other objects of the invention, which will become apparent from the description which follows, are accomplished by first engaging the taut rope segment at two locations so as to constrain the motion of the rope in one direction along a transverse axis of the rope. A deflecting means is then used to engage the rope at a location between the two constrained points and force the rope outward along the same transverse axis in which motion is constrained at the two initial points of engagement. By deflecting the rope from its initial path, the path length is increased and any slack remaining in the rope segment may be taken out.

Two preferred embodiments of the invention each entail the use of two pivotally connected members. In the first preferred embodiment, a stationary channel member is placed adjacent a rope segment. Means for constraining the rope segment at the two initial points of engagement are positioned on the stationary channel member. A deflecting channel is pivotally connected to the stationary channel member, with deflecting means positioned at one end of the deflecting channel. The deflecting channel is rotated relative to the stationary channel member, causing the deflecting means to force the rope outward on a lengthened path.

In the second embodiment, a deflecting means is positioned at a pivot point connecting two deflecting members. When a downward force is applied to the outer ends of the deflecting members, the deflecting means is forced outward, causing the rope to depart from its initial pathway and thereby removing any slack existing in the rope.

DETAILED DESCRIPTION OF THE INVENTION

Figures 1, 2, 3:
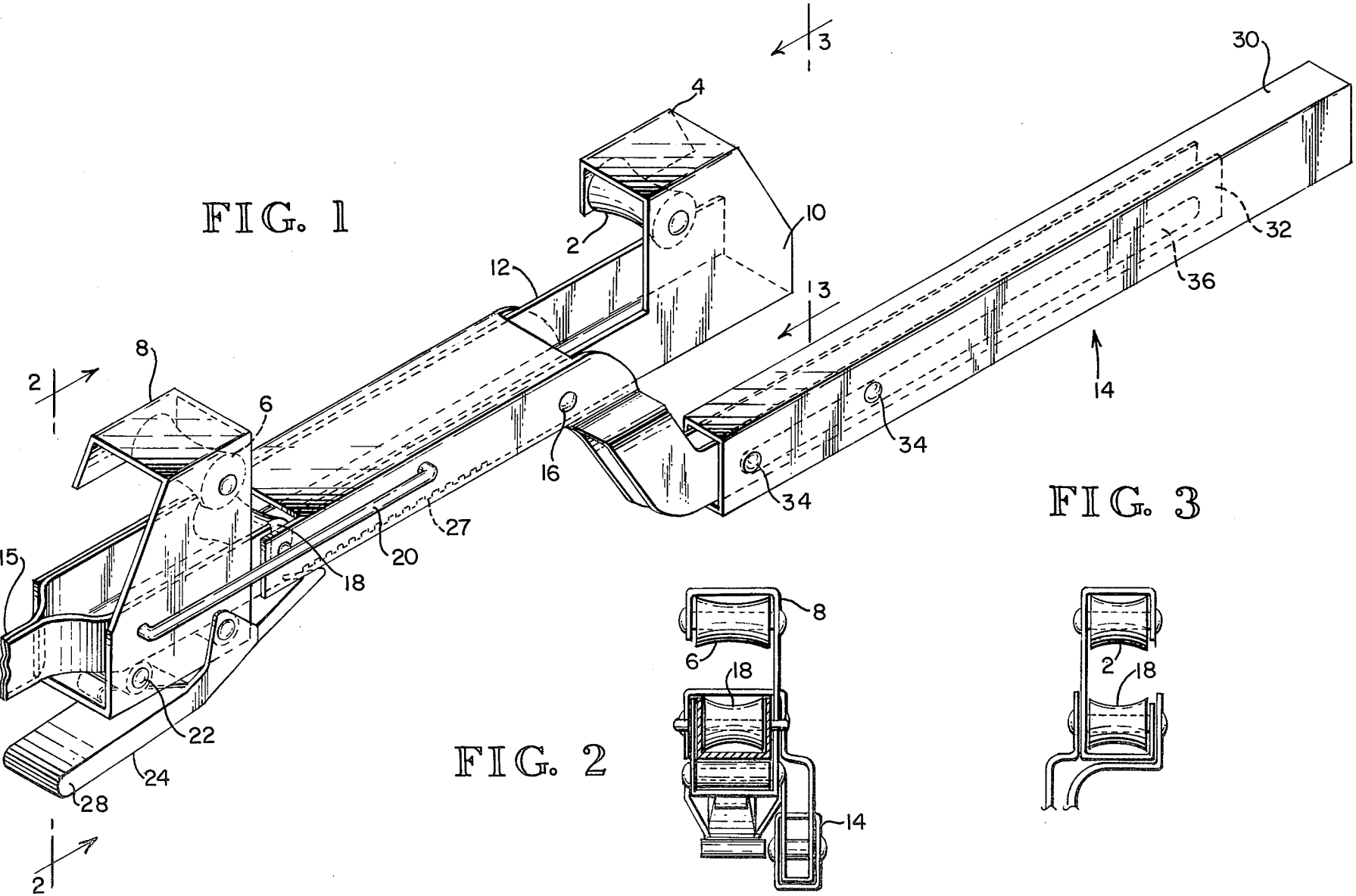
FIG. 1 is an isometric view of a preferred embodiment of the invention.
FIG. 2 is a cross-sectional view taken along line 2—2 in FIG. 1.
FIG. 3 is a cross-sectional view taken along line 3—3 in FIG. 1.
Figure 4:
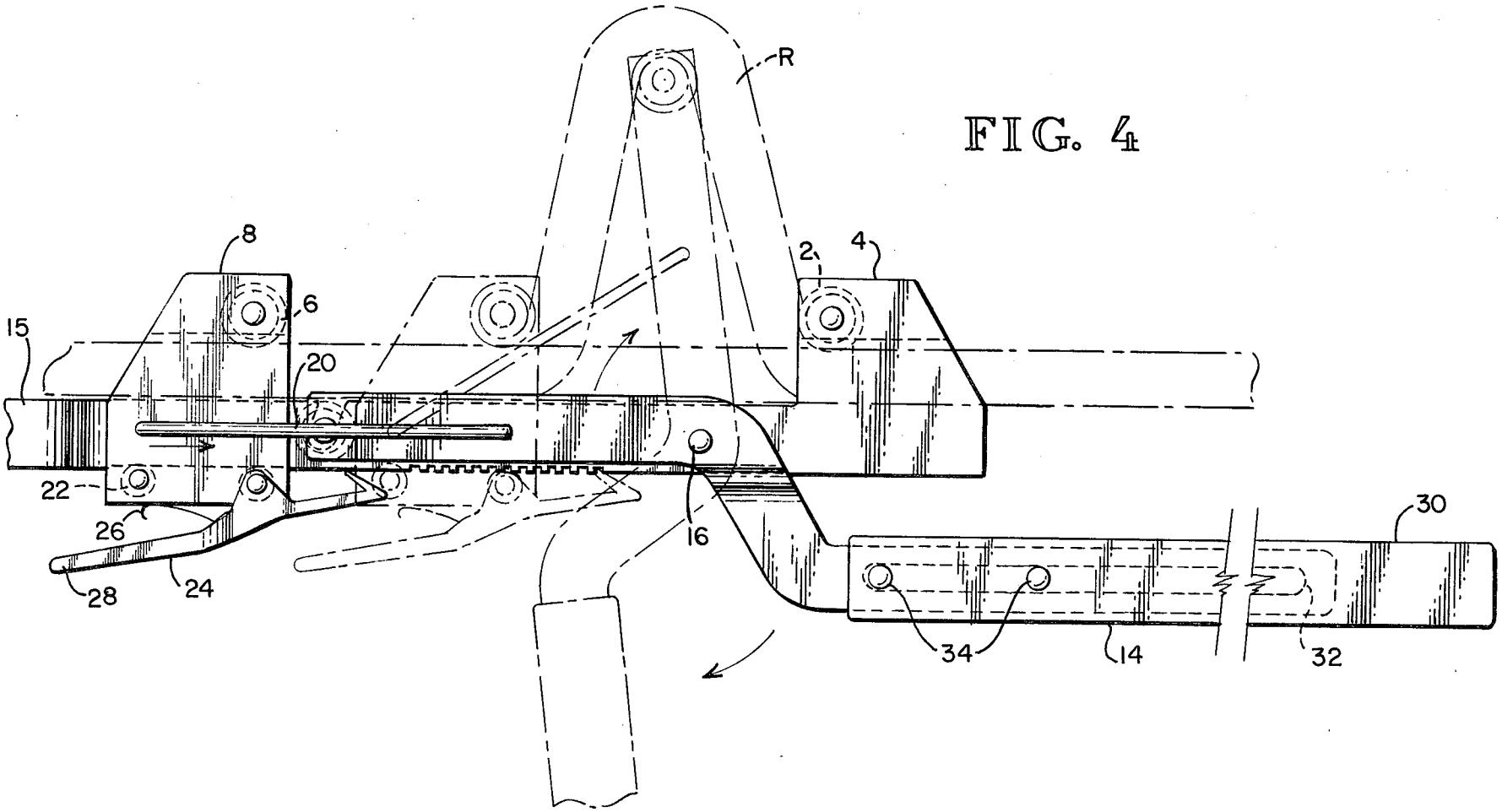
FIG. 4 is a front elevation view showing a deflected rope and the deflecting channel rotated to a near vertical position in phantom lines.
Figure 7:
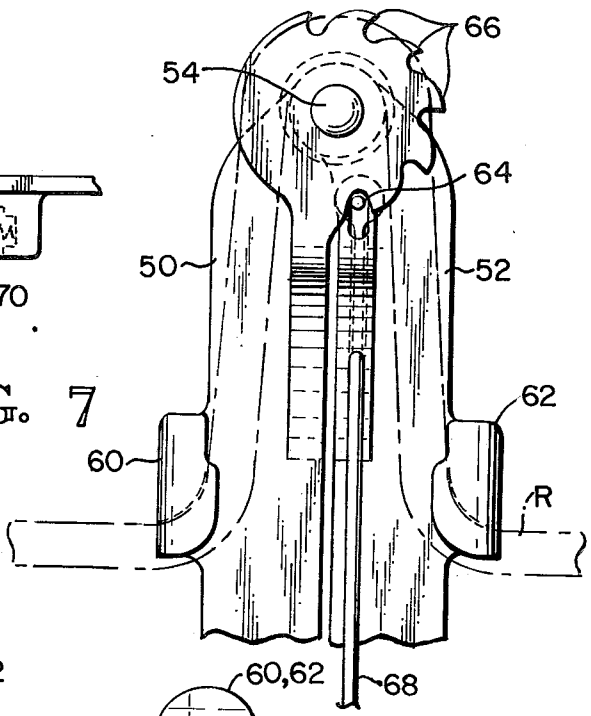
FIG. 7 is a front elevation view of the alternative embodiment showing a rope in deflected position.
Figure 8:
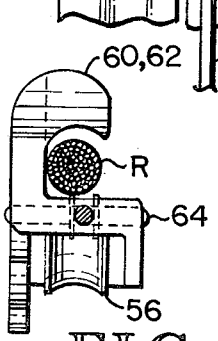
FIG. 8 is a cross-sectional view taken along line 8—8 in FIG. 6.
Figure 5:
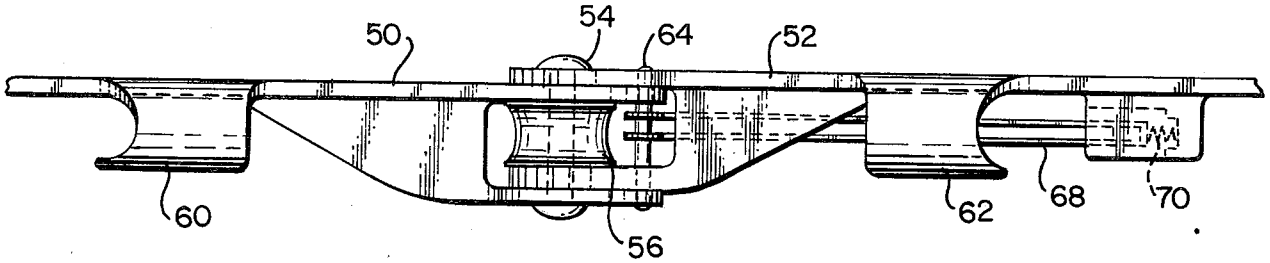
FIG. 5 is a plan view of an alternative embodiment of the invention.
Figure 6:
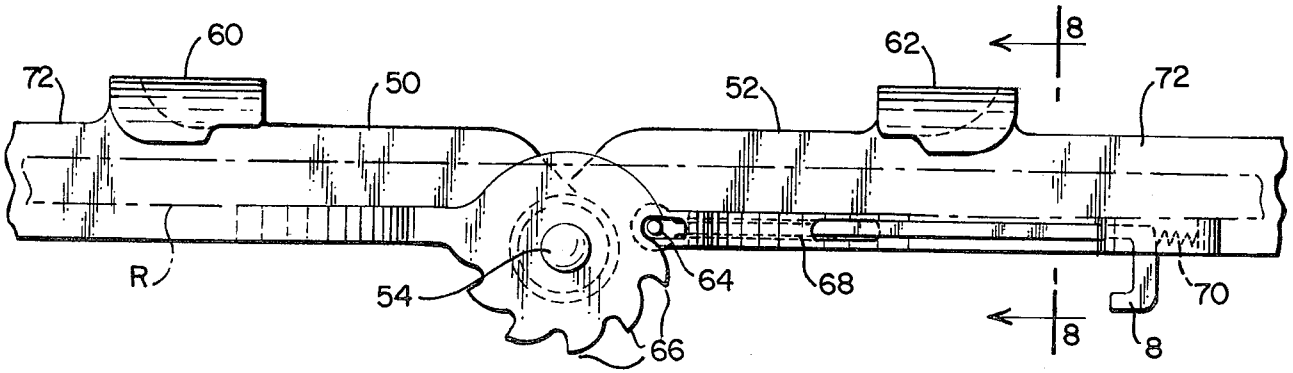
FIG. 6 is a front elevation view of the alternative embodiment of the invention in a neutral position.

A preferred embodiment of the invention, as best shown in FIG. 1, initially engages a rope segment R (see FIG. 4) at two locations: at a roller 2 depending from a stationary rope guide assembly 4 and at a roller 6 depending from a movable rope guide assembly 8. Both roller guide assemblies extend from an elongated stationary channel member 10 to which a deflecting channel 12 member is pivotably connected.

To use the invention, a rope segment R is placed between the rollers 2,6 and within the stationary channel member 10. The deflecting channel member 12, initially positioned substantially parallel to the stationary channel member 10 and below the rope segment R, is pivotally secured to channel member 10 by pin 16 and is forced upward by applying a downward force to the handle 14 which extends from the deflecting channel member 12 beyond the pivot pin 16. A deflecting means, such as roller 18, located at the projecting end of the deflecting channel member 12 engages the rope segment R at a location between the two rollers 2,6 and forces the rope segment R out of its straight-line pathway, as shown in phantom in FIG. 4. As the deflecting channel 12 is pivoted upward out of its initial horizontal position, a pair of tow rods 20 attached at one end to the deflecting channel 12 and at the other end to the movable rope guide assembly 8, pull the movable rope guide assembly 8 along the stationary channel member 10 toward the stationary rope guide assembly 4. (See FIG.

4.) The movable rope guide assembly 8 is slidably attached to the stationary channel member 10 by means of two slidable rope rollers 22 positioned between the underside of the web of the stationary channel member 10 and the top surface of the bottom side of the movable rope guide assembly 8.

The deflecting channel member 12 is preferably securable in a plurality of positions inclined relative to the stationary channel member by means of a spring-loaded tension latch 24 which depends from the movable rope guide assembly 8 and engages any of a series of ratchet teeth 26 located on the underside of the web of the stationary channel member 10 to prevent the movable rope guide assembly 8 from sliding along the stationary channel member 10 in a direction away from the stationary rope guide assembly 4.

Once the movable rope guide assembly 8 is no longer free to retreat to its neutral position, the tow rods 20 serve the additional function of supporting the deflecting channel 12 in an inclined position, thereby keeping the rope segment R in a deflected position. In order to release the tension latch 24 and allow the tension in the rope segment R to be reduced, the tension latch spring 26 (see FIG. 4) is depressed by applying an upward force on the tension latch handle 28, causing the end of the tension latch 24 opposite the handle 28 to be disengaged from the ratchet teeth 26, thereby allowing free movement of the movable rope guide assembly 8 along the stationary channel member 10.

The first embodiment of the invention also preferably includes a handle 14 attached to the deflecting channel member 12 which is extendable to different lengths by means of an outer handle sleeve 30 which fits over an inner handle 32 and is secured by means of handle extension bolts 34 which project through apertures in the outer handle sleeve 30 and a narrow slot 36 in the inner handle 32.

A second preferred embodiment of the invention, shown in FIGS. 5–8, is essentially comprised of two elongated deflecting members 50,52 which are pivotally connected to one another by means of a pivot pin 54. Ascending from each of the deflecting members are rope-engaging means 60,62 which arch out transversely from the deflecting members, the shape of the arch conforming to the size of the rope segment R to be tightened.

To use this embodiment of the invention, the two deflecting members 50,52 are spread out in an essentially parallel position alongside a rope segment R, with the underside of the arched rope-engaging means 60,62 partially encircling the upper half of the rope segment R at two locations. A downward force is then applied to the projecting ends of the deflecting members 50,52, forcing the rope-deflecting means 56, which is mounted on the pivot pin 54 (see FIG. 5) upward, engaging the rope at a location between the two engaging means 60,62 and deflecting it upward while the two engaging means 60,62 constrain the upward motion of the rope segment R, thus deflecting the rope out of its original straight-line pathway. (See FIG. 7.)

The deflecting members 50,52 are preferably securable at a plurality of angles relative to one another by means of a restraining rod 64 which is positioned near the pivot point and extends transversely from one deflecting member 52, substantially parallel to the pivot pin 54, to prevent rotation of the deflecting members 50,52 relative to one another by engaging one of a set of shark fin-like projections 66 extending from the nonprojecting end of the other deflecting means 50. The restraining rod 64 is perpendicularly attached to a spring-loaded retracting rod 68 which is mounted through the lower portion of the first deflecting member 52. When a downward force is applied to the projecting ends of the deflecting means 50,52, the restraining rod 64 slides over the convex side of one of the shark fin-like projections 66 and drops into the back side of the fin. When the downward force is removed, the restraining rod 64 lodges in a notch formed by the back side of the shark fin-like projection 66 to prevent the deflecting means 50,52 from returning to a parallel position.

When the retracting rod 68 is pulled outward, away from the pivot pin 54, compressing the restraining spring 20, the restraining rod 64 is sufficiently retracted along the longitudinal axis of the first deflecting member 52 so as to avoid contacting the shark fin-like projections 66 and allow the deflecting means to rotate freely relative to one another.

The deflecting members 50,52 preferably include handles 72 which extend from the projecting ends of the deflecting means 50,52 to permit greater leverage to be obtained when the downward force is applied to the deflecting members in order to force the deflecting means 56 upward.

I claim:

1. An apparatus for increasing the tension in a taut rope segment wherein a portion of the segment is adjacent the apparatus, which comprises:

two elongated deflecting members, each deflecting member pivotally connected to the other at one end of each deflecting member such that the deflecting members are aligned longitudinally when in a neutral position and the pivotally connected ends of the deflecting members move upward with respect to the nonconnected ends when a downward force is applied to the nonconnected ends;

means for deflecting the portion of the rope segment adjacent the pivotal connection so that said portion will move upward with respect to the nonconnected ends of the deflecting members in conjunction with the pivotally connected ends of the deflecting members;

means for engaging the rope segment at locations adjacent at least one point on each deflecting member spaced apart from the pivotal connection and restraining motion of the rope segment away from such points so that the rope segment will remain adjacent to the such points on each deflecting member when the connected ends of the deflecting members move upward with respect to the nonconnected ends; and means for securing the deflecting members at a plurality of angles relative to one another.

2. The apparatus of claim 1, further including a handle extending from the nonconnected end of each deflecting member in a direction away from the pivotal connection.

3. The device of claim 1 wherein the engaging means are comprised of a pair of arches which ascend from the deflecting members and constrain motion of the rope segment away from the deflecting members by partially encircling the rope segment, the underside of said arches being shaped to conform to the approximate shape of the rope segment to be tightened.

* * * * *